United States Patent [19]

Jaworski et al.

[11] 4,341,035

[45] Jul. 27, 1982

[54] GRAPHIC TOY

[75] Inventors: Eugene Jaworski, Park Ridge; Harry Disko, South Barrington, both of Ill.

[73] Assignee: Marvin Glass & Associates, Chicago, Ill.

[21] Appl. No.: 117,541

[22] Filed: Feb. 1, 1980

[51] Int. Cl.[3] ..... A63H 11/00

[52] U.S. Cl. ..... 46/135 R; 46/47; 434/74; 434/28; 40/587

[58] Field of Search ..... 46/135 R, 1 R, 47, 37, 46/36, 49, 207; 40/495, 474, 587; 434/74, 28; 273/155, 157 A, 142 H, 142 HA, 142 R, 142 D, 161; 272/8 N, 8 R, 8 D

[56] References Cited

U.S. PATENT DOCUMENTS

| | | | |
|---|---|---|---|
| 1,618,710 | 2/1927 | Hose | 46/135 R X |
| 1,756,021 | 4/1930 | Escasena | 40/587 |
| 2,861,808 | 11/1958 | Musser | 46/135 R X |
| 3,122,859 | 3/1964 | Reaux, Jr. | 46/37 |
| 3,155,430 | 11/1964 | Schindler | 40/587 X |
| 3,986,696 | 10/1976 | Malmer | 46/37 X |

FOREIGN PATENT DOCUMENTS

| | | | |
|---|---|---|---|
| 767643 | 7/1935 | France | 46/135 R |
| 22759 | of 1898 | United Kingdom | 46/49 |

*Primary Examiner*—Gene Mancene
*Assistant Examiner*—Mickey Yu
*Attorney, Agent, or Firm*—Mason, Kolehmainen, Rathburn & Wyss

[57] ABSTRACT

A toy for randomly creating stationary and moving graphic reprensentations and images includes a multi-sided housing for mounting the image producing mechanism. The image producing mechanism includes at least a pair of rotatable, planar elements or sheets and a drive mechanism. One sheet includes graphics combined with a plurality of cutout portions. Another sheet is mounted behind the first sheet and includes multiple graphics that are intended, in their stationary position, to be aligned with the cutouts of the first graphics to complete a picture or image. The first sheet is rotatably mounted and weighted to always assume the same orientation. The second sheet is also rotatably mounted within the housing and is connected to the drive mechanism. The drive mechanism includes a rotatable pendulum within the housing so that upon rotation of the housing, the pendulum swings downwardly actuating the drive mechanism. The second sheet is rotated several times by the drive mechanism so as to provide a random selection of composite images by the two sheets in response to a single or partial rotation of the housing of the toy.

15 Claims, 5 Drawing Figures

GRAPHIC TOY

BACKGROUND OF THE INVENTION

1. Field of the Invention

The present invention generally relates to graphic art toys and in particular to a new and improved toy that randomly creates a variety of images or graphic designs.

2. Brief Description of the Prior Art

There are many types of graphic illustrating toys such as the type wherein the child draws the desired graphic with the assistance of guides, plates or lines that come with the toy. Such a toy is entertaining for older children and developes certain skills. Such a toy is more difficult to use by younger children, however, particularly those children whose graphic skills are not developed. Accordingly, it is desirable for younger children or older children with less refined skills to provide a toy that will randomly create a plurality of illustrations by simple action of the toy.

SUMMARY OF THE INVENTION

An object of the present invention is to provide a new and improved toy for randomly providing graphic images.

Another object of the present invention is to provide a new and improved toy that is durable and easy to manufacture and provides a random effect in producing different graphic images.

The present invention is directed to a new and improved toy for producing graphic images that includes a multi-sided housing that upon being rotated or being moved from one side to another produces different images. The images are provided by first and second discs rotatably mounted within the housing. The first or overlay disc is weighted and freely rotatable within the housing and rotates or pivots to a predetermined orientation in accordance with the rotation of the housing.

A second disc is mounted within the housing and is connected to a step up drive means or gear train that is actuated by a pendulum, such that upon rotation of the housing, the pendulum rotates the gear train. The gear train in turn rotates the second disc several times relative to the pendulum and the first disc. The first disc includes a graphic design with cutouts and the second disc provides a plurality of different graphics that are intended to be aligned with the cutouts upon completion of rotation of the first and second discs providing a plurality of different images depending on where the first and second discs stop rotating relative to each other.

BRIEF DESCRIPTION OF THE DRAWINGS

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
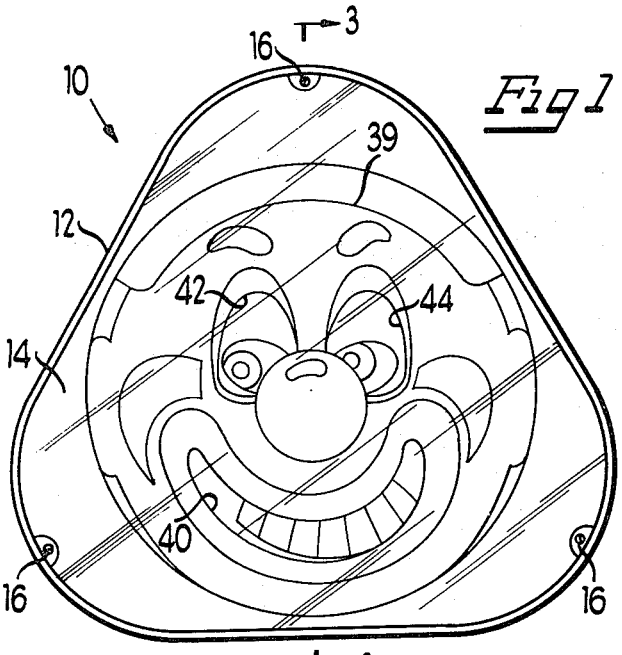
FIG. 1 is a front elevational view of a toy constructed in accordance with the principles of the present invention.

With reference now to the drawing and initially to FIG. 1, there is illustrated a toy generally designated by the reference numeral 10 that is intended to randomly provide a plurality of graphic illustrations that in the preferred embodiment is a changing facial expression. The toy 11 includes a multi-sided housing 12 that in the preferred embodiment is three-sided or triangular in shape.

Figure 5:
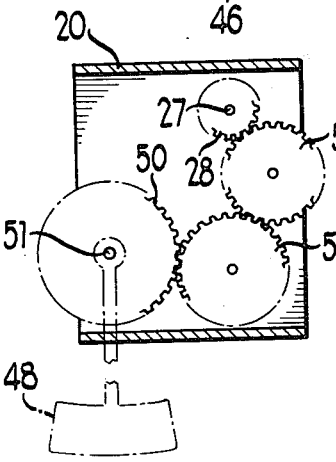
FIG. 5 is a view taken along line 5—5 of FIG. 4.

The housing 12 is open on one end and includes a transparent cover 14 fabricated from glass or the like that is connected to the housing 12 by a plurality of fasteners 16. In addition, a divider or center mounting plate 18 is mounted within the housing 12. A gear housing is secured to the back of plate 18 or cover 20 and houses a stepup gear train generally designated by the reference numeral 22 (FIG. 5). The gear train 22 or drive means rotates the graphic disc 24 mounted on the axle 27 of a final gear 28 in the gear train 22. The graphic disc 24 includes a plurality of graphics that, as illustrated in the preferred embodiment, include graphic illustrations of a fanciful hair line 25, a tongue 26, several eyes 28, a frowning mouth 30 and a set of teeth 32.

Figure 2:
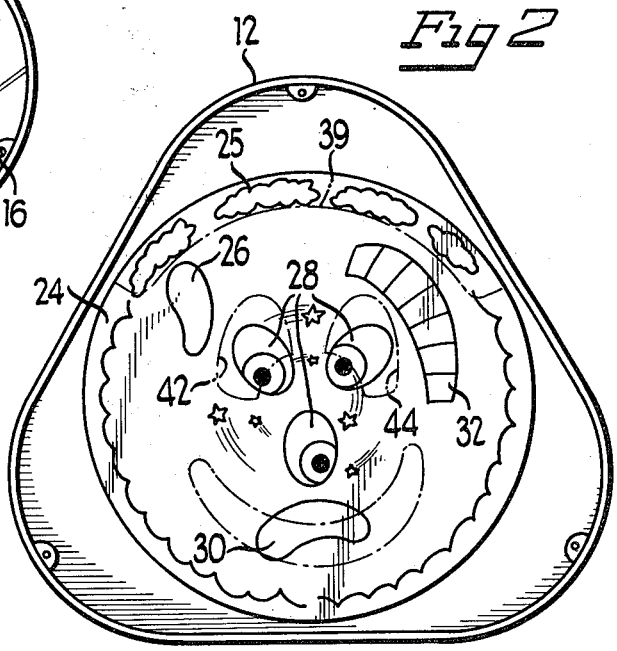
FIG. 2 is a view of the toy of FIG. 1 with the overlay disc removed.
Figure 3:
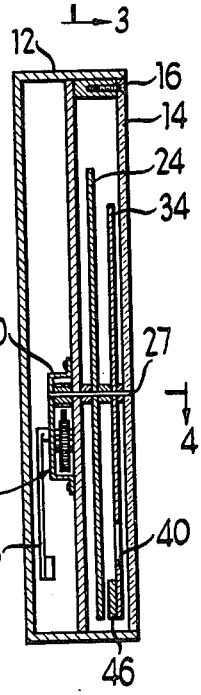
FIG. 3 is a view taken along line 3—3 of FIG. 1.
Figure 4:
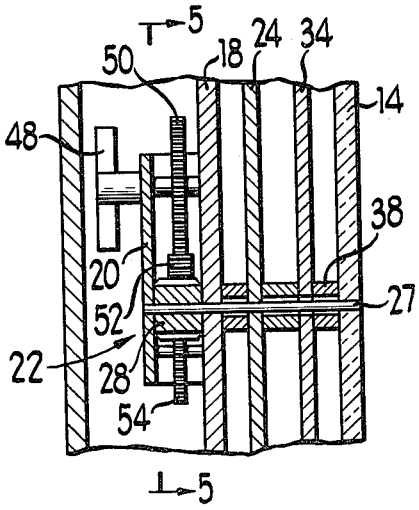
FIG. 4 is an enlarged view taken along line 4—4 of FIG. 3.

Acting in conjunction with the graphic disc 24 is an overlay disc 34 that is freely mounted on the shaft 27 within a bearing or spacer 38 that extends between the cover plate 14, the graphic disc 24 and the dividing plate 18. The overlay disc 34, in the preferred embodiment, includes the general graphic design of a clown face but in addition, includes cutouts such as a hair line cutout 39, a mouth cutout 40 and eye cutouts 42 and 44, as shown in phantom in FIG. 2. The drive means 22 is geared to always rotate the graphic disc $n(2\pi)+m/3(2\pi)$ radians, where n and m are integers. This equation provides the end result of the random number of rotations and fractions thereof when the housing is moved to any of its three sides and after the pendulum stops oscillating. Therefore, the graphic disc will properly align with the cutouts 39, 40, 42 and 44. As can be understood, the eyes 28 on the disc 24 are radially aligned with the cutouts 42 and 44 and the tongue 26, mouth 30 and teeth 32 are radially aligned with the cutout 40.

Accordingly, different images are produced by the rotation of the discs 24 and 34 by the alignment of different components such as the tongue 26 or the teeth 32 in the different cutouts on the overlay disc 34 such as, for example, the positioning of the tongue 26 or the teeth 32 in the mouth cutout 40. Alignment of different graphics on the graphic disc with different cutouts in the overlay disc 34 is obtained by a first weight 46 mounted at the outer peripheral edge of the overlay disc 34 which always moves downwardly. Consequently, by rotating the toy 10 from a position wherein one side of the housing 12 is positioned on the ground to another adjacent side positioned on the supporting surface. In the preferred embodiment, this results in 120° rotation of the pendulum 48 and the overlay disc positioning the face of the disc 34 in an upright position when viewed. As the toy 10 is rotated to another side, the pendulum 48 and the weight 46 will oscillate slightly from the vertical position before finally coming rest in the vertical position. This action adds to the appearance of an image being randomly produced by the toy 10.

The gear train includes a first gear 50 secured to a shaft 51 which is rotated 120° by the pendulum 48. The rotation of the gear 50 is stepped up through intermediate gears 52 and 54 to the small final gear 28. Thus, the 120° rotation of the pendulum 48 and the first gear 50 is stepped up through the gear train 22 resulting in several rotations of the final gear 28 and thus the graphic disc 24 as previously described. The multiple rotations of the graphic disc 24 relative to the overlay disc 34 provide a random appearance in selecting the image created by the discs 24 and 34 thus insuring prolonged entertainment of the user.

Many modifications and variations of the present invention are possible in light of the above teachings. Thus, it is to be understood that, within the scope of the appended claims, the invention may be practiced other than as specifically described.

What is claimed and desired to be secured by Letters Patent of the United States is:

1. A graphic toy, comprising:

a multi-sided housing also including a front and a back;

a graphic disc rotatably mounted in said housing;

a second disc coaxial with said graphic disc and rotatably mounted in said housing; and drive means in the housing for rotating said graphic disc a plurality of revolutions in response to rotation of said housing from being positioned on one of said sides to another.

2. The toy of claim 1 including a pendulum member rotatably mounted on said housing and drivingly connected to said drive means to actuate said drive means upon rotation of said housing to another side.

3. The toy of claim 1 including indicia on said second disc for interacting with the graphics on said graphic disc.

4. The toy of claim 1 wherein said drive means is connected to said graphic disc and said second disc is freely rotatable within the housing so that the graphic disc rotates substantially more than said second disc.

5. The toy of claim 4 wherein said second disc is weighted to rotate less than one full revolution upon rotation of the housing to another side.

6. The toy of claim 5 wherein said second disc is an overlay disc including graphics and having at least a portion thereof through which said graphic disc is visible.

7. The toy of claim 6 wherein said graphic disc includes indicia for aligning with said overlay disc and said drive means includes means for maintaining alignment between the indicia on said graphic disc and said overlay disc when said graphic disc and overlay disc come to rest.

8. A graphic toy, comprising:

a multi-sided housing wherein each side defines a base upon which said toy may be positioned;

said housing also including a front and back;

first and second discs rotatably mounted in said housing, each of said first and second discs including indicia thereon, said first disc includes images of a face and said second disc includes cutouts thereon;

drive means mounted in said housing and secured to said first disc; and weight means secured to said drive means for rotating said first disc upon rotation of the housing to being positioned on another base.

9. The toy of claim 8 wherein said images on said first disc may be aligned with said cutouts.

10. A graphic toy, comprising:

a multi-sided housing having X number of sides wherein each side defines a base upon which the housing may be supported, said housing also including a front and back; and a graphic disc rotatably mounted in said housing;

a second overlay disc rotatably mounted and axially aligned with said graphic disc; and drive means mounted in said housing and secured to said graphic disc for rotating the graphic disc from a starting position through an angle of $n(360)^\circ + [1/x]m/x\ (360)^\circ$ when it has come to rest relative to its starting position upon reorientation of the housing from one side to another wherein n is an integer and m is a positive number.

11. The graphic toy of claim 10 where x equals 3.

12. The graphic toy of claim 10 wherein said graphic disc includes a plurality of sets of indicia.

13. The graphic toy of claim 12 wherein said plurality of sets equals x.

14. The graphic toy of claim 13 wherein said overlay disc includes a plurality of portions through which said graphic disc is visible so that one of said plurality of sets of indicia are visible when said housing rest on one of said bases.

15. A graphic toy, comprising:

a multi-sided housing wherein each side defines a base upon which said toy may be positioned;

said housing also including a front and back;

first and second discs rotatably mounted in said housing, each of said first and second discs including indicia thereon;

said second disc being weighted to rotate less than one full revolution upon rotation of said housing from one side to another;

drive means mounted in said housing and secured to said first disc; and weight means secured to said drive means for rotating said first disc upon rotation of the housing to being positioned on another base.

* * * * *